US006758230B2

(12) United States Patent
Bogart, Jr.

(10) Patent No.: US 6,758,230 B2
(45) Date of Patent: Jul. 6, 2004

(54) AIRPLANE HANGAR

(75) Inventor: Donald Bogart, Jr., Long Beach, CA (US)

(73) Assignee: Donald W. Bogart, Jr., Long Beach, CA (US)

( * ) Notice: Subject to any disclaimer, the term of this patent is extended or adjusted under 35 U.S.C. 154(b) by 71 days.

(21) Appl. No.: 09/891,426

(22) Filed: Jun. 27, 2001

(65) Prior Publication Data

US 2002/0043030 A1 Apr. 18, 2002

(51) Int. Cl.[7] ..... E04H 15/100

(52) U.S. Cl. ..... 135/87; 135/124; 52/63; 52/73; 52/DIG. 14

(58) Field of Search ..... 135/87, 123, 124, 135/908; 52/63, 73, DIG. 14

(56) References Cited

U.S. PATENT DOCUMENTS 2,511,974 A * 6/1950 Finken et al.
2,520,055 A * 8/1950 Pomerance
2,556,617 A * 6/1951 Harrah
2,880,741 A * 4/1959 McGrand
3,234,695 A * 2/1966 Johnson
3,270,755 A * 9/1966 Horvath
3,401,492 A * 9/1968 MacDonald
3,708,200 A * 1/1973 Richards
3,818,652 A 6/1974 Pierce
3,906,691 A 9/1975 Grenet
4,008,730 A * 2/1977 Keklak et al.
D274,157 S * 6/1984 Freeland
4,542,759 A 9/1985 Kyner, Jr.
4,557,284 A * 12/1985 Bray
4,619,099 A 10/1986 Sircovich
5,390,688 A * 2/1995 Lipman
6,273,114 B1 * 8/2001 Schaefer

* cited by examiner

*Primary Examiner*—Robert Canfield
(74) *Attorney, Agent, or Firm*—Marcia A. Devon

(57) ABSTRACT

A novel airplane shelter provides a plurality of arched vertical support members arranged axially along a line corresponding to the fuselage of an airplane to be sheltered. A cantilevered beam is attached to the apex of each arched vertical support member, forming a "spine" along the top of the aligned arched support members. The cantilevered beam is attached at one end to the rearwardmost arched support member, and the opposite end extends forwardly past the forwardmost arched support member to a point corresponding to the forwardmost point of an airplane to be sheltered. Separate lateral support members are placed at points corresponding to the wingtips of the airplane. The result is an open frame that defines a volume capable of enclosing an airplane. A covering material is placed over the open frame and stretched taut over the entire structure.

7 Claims, 4 Drawing Sheets

AIRPLANE HANGAR

BACKGROUND AND SUMMARY OF THE INVENTION

A need has long existed for a reliable, convenient and relatively inexpensive hangar or shelter to protect airplanes and other winged aircraft, such as gliders, from the elements while parked on a flight line or otherwise out of use on the ground.

Currently, the two major existing solutions for sheltering airplanes are covers and structures. Covers, such as simple canvas or plastic tarpaulins, are relatively inexpensive, but suffer from several disadvantages. Covers, being stretched over the wings and body of the airplane, come into contact with exterior surfaces and objects, either causing damage directly or indirectly such as when dust is entrapped in the cover and wind causes the cover to flutter on the aircraft surface. This can cause scratching and other damage to polished and/or painted surfaces, as well as causing damage to external objects such as antennae, which can lead to unsafe operating conditions. Further, covers are often difficult for a single person to properly drape and secure over the airplane, which is very inconvenient for pilots flying solo. Additionally, covers tend to be form-fitting over the airplane, making it difficult or even impossible to perform maintenance or safety checks or to enter the aircraft. Even further, a cover must be removed and properly stored each time the airplane is to be used, then replaced over the airplane when the airplane is returned to the flight line, adding to the time and effort required to otherwise enjoy flying. Pilots end up making several significant sacrifices in order to save on the initial investment in a cover.

While structures, such as traditional hangars, offer one-time setup, they also suffer from several disadvantages. Structures require much more in the way of materials than a cover, and are therefore much more expensive. Further, they often require a foundation, such as cement footers, and are not easily constructed except by professionals. Structures using a relatively rigid outer surface often also include doors, which are subject to jamming, and require their own expensive hardware and careful construction. Additionally, structures are often inherently expensive in that they either have a regular shape (i.e., a square or rectangular floor plan), which ends up using extra supports and covering material to extend over the wings, resulting in a large amount of unused volume inside the structure, or the structure is configured to conform more closely to the shape of the airplane (e.g., a "T-hangar"), which requires use of multiple sizes and lengths of supports and covering material in order to follow an irregular floor plan.

Due to the inconvenience of covers and the expense of structures, many airplane owners may opt to forego sheltering their airplanes, leaving them unprotected from the elements, leading to excessive deterioration of exterior surfaces and equipment. Undetected, the resulting corrosion could, in time, lead to catastrophic alteration of the airfoil surfaces, causing dangerous flying conditions. Exposure to the elements is also damaging to aircraft interiors, avionics and electronics.

What is needed is a low-cost structure that includes the advantages of a cover. Such a structure should be relatively easy to assemble without professional assistance, substantially cover an airplane to protect it from the elements, and still permit convenient access to the airplane for various purposes. Such a structure is provided in the instant invention.

Consequently, a novel airplane shelter is described herein which enhances a structure with the best features of a cover. In order to achieve the advantages of this airplane shelter, a substantially rigid skeletal frame has been invented that, with the use of a unique cantilever structure, provides connections and support for cables and material to enclose and protect an airplane. A plurality of arched vertical support members are arranged axially along a line corresponding to the fuselage of an airplane to be sheltered. The line extends from essentially the trailing edge of the airplane's wings to a point at or just past the trailing edge of the airplane's tail assembly. A cantilevered beam is attached to the apex of each arched vertical support member, forming a "spine" along the top of the aligned arched support members. The cantilevered beam is attached at one end to the rearwardmost arched support member, and the opposite end extends forwardly past the forwardmost arched support member to a point corresponding to the forwardmost point of an airplane to be sheltered. Separate lateral support members are placed at points corresponding to the wingtips of the airplane to be sheltered. The result is an open skeletal frame that defines a volume which is capable of enclosing an airplane. A covering material is placed over the open skeletal frame and stretched taut, by attachment to the extreme elements of the skeletal frame, covering all of the arched vertical support members, the cantilevered beam, and the open space between the forwardly-extending portion of the cantilevered beam and the two lateral support members. adjacent to each wingtip of the airplane to be sheltered The covering material is attached to each of the lateral support members. Cables may be attached between the cantilevered beam and the lateral support members to provide additional support for the covering material. The resulting structure, in top plan view, resembles an arrow, where the shaft of the arrow houses the airplane fuselage, and the arrowhead houses the wings, cockpit, and nose of the airplane. The forwardmost end of the cantilevered beam can be secured by a rope,chain, or rigid member or similar element attached to a point on the ground to prevent excessive motion and to keep the material taut in the direction between lateral support members across the cantilevered beam. Additional covering material may optionally be used to provide door flaps and/or walls. The elements of the invention may optionally be provided in a kit for assembly by an airplane owner.

As will be seen in the following description and drawings, the claimed invention provides an airplane shelter which combines the low cost and easy assembly of a cover, while also providing the sturdy construction and ability to access the airplane found in structures. The use of a cantilevered central beam and small lateral support members, instead of expensive vertical walls and horizontal ceiling structures, to support a covering material provides sufficient shelter to protect an airplane from the elements while still allowing sufficient access to the airplane for loading, unloading, maintenance, and other purposes.

DETAILED DESCRIPTION OF THE PREFERRED EMBODIMENT

While those skilled in the art will recognize that the present invention can easily be adapted for use with a wide variety of aircraft, the description herein assumes, but is not intended to be limited to, a single engine monoplane of size and dimensions similar to any of many makes and models being flown today.

Figure 1:
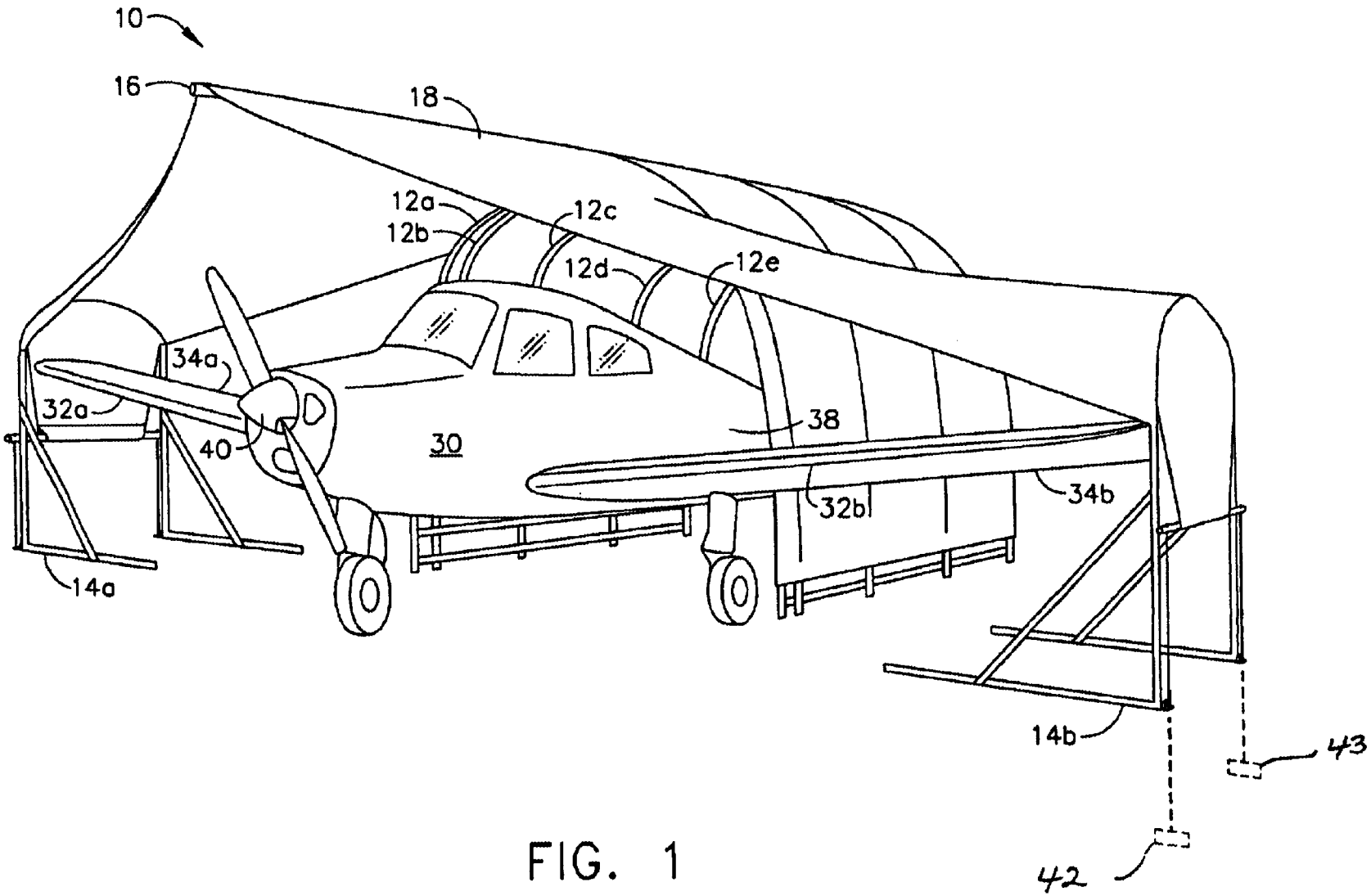
FIG. 1 is an isometric perspective view of the present invention sheltering a typical small airplane.

As can be seen in FIG. 1 and in subsequent figures, the present invention provides an airplane shelter 10 for sheltering of an airplane 30. The shelter 10 is comprised of a plurality of vertical support members 12*a–e*, a cantilevered apex beam 16, a pair of lateral support members 14*a,b*, a removable anchor member 24 and a covering material 18. Optional elements include central support cables 20*a,b*, forward support cables 22*a,b*, front door flaps 26*a,b*, cantilever support cable 21 and cable anchor 23, supplemental cantilevered beams 17*a, b*, and walls.

The vertical support members 12*a–e* are assumed to be essentially arched in configuration, but may be of any of a number of shapes which will rest on the ground on either side of the fuselage 38 of airplane 30 and extend over the top of fuselage 38 such that covering material 18 maybe supported over the top and along both sides of fuselage 38. For example, rectangular, triangular, or other symmetrical configurations will also work, as long as there is sufficient room for the tail assembly of airplane 30 to pass beneath each vertical support member 12*a–e*.

Each vertical support member 12*a–e* includes a respective apex 13*a–e*, and may be made of wood, metal, or other suitable material. Choice of material may depend on the size of the shelter to be constructed, prevailing weather conditions, expense constraints, the temporary or permanent nature of the intended use of the shelter, or other factors. Hollow steel tubing offers the advantages of strength, low expense, and light weight, though other materials, such as wood, aluminum, plastic, etc., may be used.

The vertical support members 12*a–e* are placed in an aligned fashion along a line at least as long as the distance from the trailing edge 34*a,b* of the wings 32*a,b* of airplane 30 to the rearwardmost point of the tail assembly. The respective apexes 13*a–e* of vertical support members 12*a–e* are aligned along a line parallel and directly above the longitudinal centerline of the fuselage 38 of airplane 30, with the cross-section of each arch parallel to the others such that a "tunnel" is formed of a size able to accommodate the passing through of the tail assembly of airplane 30 and able to contain the entire fuselage 38 and tail assembly of airplane 30. The vertical support members 12*a–e* are spaced apart to provide sufficient support for the covering material 18 over the length of the "tunnel". The ends of vertical support members 12*a–e* may rest freely on the ground, but should be attached or weighted to prevent unintended movement of the airplane shelter 10 due to wind or minor collision of people or equipment. Those skilled in the art will recognize numerous ways to attach or weight the ends in a satisfactory manner designed to meet local conditions and individual needs.

A cantilevered apex beam 16 is laid upon the tops of the vertical support members 12*a–e* and physically attached at each respective apex 13*a–e* by bolting, welding, tying, or other suitable method. One end of the cantilevered apex beam is attached to the rearwardmost vertical support member 12*e*, while the opposite end extends forwardly past the forwardmost vertical support member 12*a* along the line defined by the aligned respective apexes 13*a–e* to a point at least as far forward as the nose assembly 40 of airplane 30. This may require the unsupported cantilevered portion of cantilevered apex beam 16 to be longer than the portion supported by vertical support members 12*a–e*. While the cantilevered apex beam 16 may be made of the same material as vertical support members 12*a–e*, it should be made of a material that is sufficiently stiff to resist excessive bending due to its own weight and the added weight of the portion of covering material 18 that it will support. The combination of the vertical support members 12*a–e* and the cantilevered apex beam 16 forms an open skeletal frame for supporting covering material 18.

Figure 8:
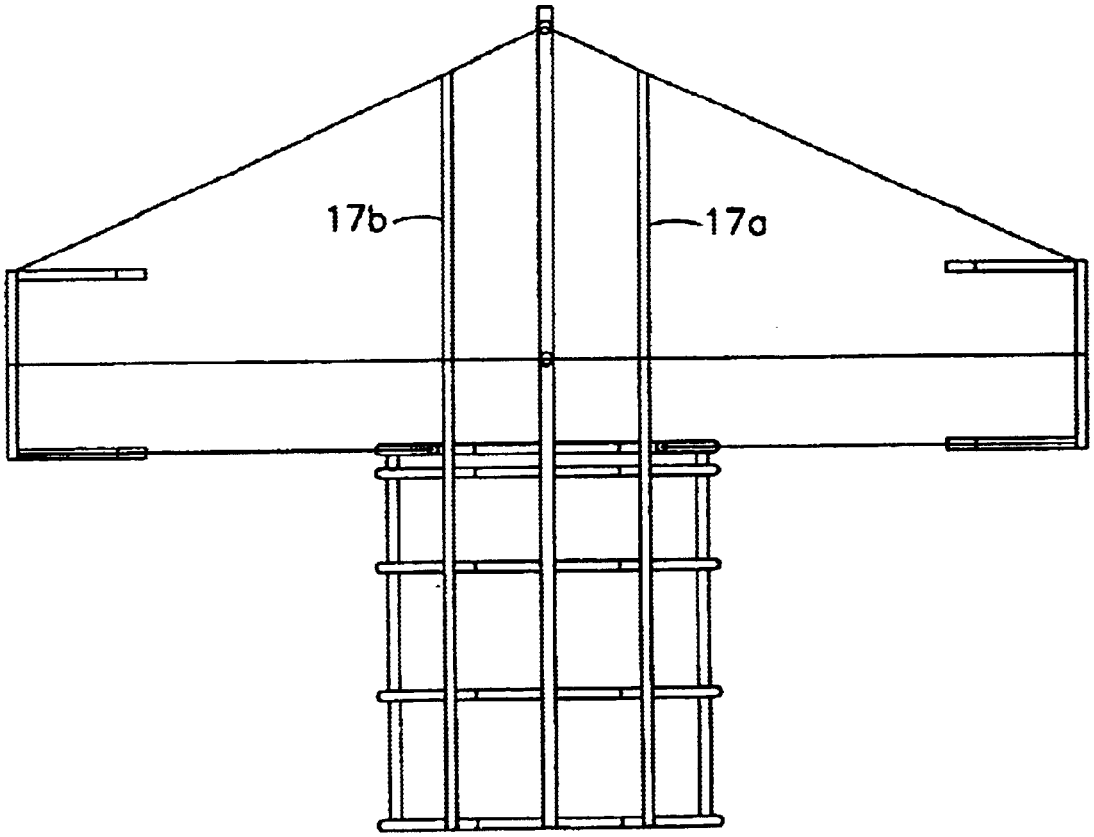
FIG. 8 depicts the present invention as shown in FIG. 2 with the additional depiction of supplemental cantilevered beams 17*a,b*.

As shown in FIG. 8, if additional support for covering material 18 is desired, supplemental cantilevered beams 17*a,b* may be additionally attached to vertical support members 12*a–e*. In such a case, it may be desirable for vertical support members 12*a–e* to have a substantially flat top so that supplemental cantilevered beams 17*a,b* are at the same height as cantilevered apex beam 16.

Unattached to the rest of the open skeletal frame described above are two lateral support members 14*a,b*, each placed just beyond a point corresponding to the respective tips of wings 32*a,b* of airplane 30. The lateral support members may be posts, poles, frames or other object sufficiently sturdy and of sufficient height to support covering material 18 and keep it raised off of airplane 30 when properly attached. As with vertical support members 12*a–e*, lateral support members 14*a,b* are preferably positively attached or weighted to the ground to avoid undesired motion or movement, such that they provide a secure anchor for covering material 18 in order to maintain the tautness of covering material 18.

A covering material 18 of cloth, canvas, plastic, or similar material, is placed over the open skeletal frame and stretched taut. It is then fastened by bolting, tying, adhesives, or other appropriate method, to sufficient spots along one or more vertical support members 12*a–e* and cantilevered apex beam 16 to prevent undesired removal or flapping due to wind or other adverse conditions. Covering material 18 is also similarly sufficiently stretched taut over each lateral support member 14*a,b*. Covering material 18 may consist of a single sheet of material configured to fit the open skeletal frame, or may consist of multiple sheets placed over the open skeletal frame in sections. If multiple sheets are used, it may be desirable to seal the sheets together by stitching, zippers, tying, heat sealing/welding, or other appropriate method, in order to prevent the elements from entering between sheets. Covering material 18 may be configured to cover only the top of the structure, leaving sides open for easy access, or may be configured to cover substantially all of the exterior of the open skeletal frame, including backs and sides, in order to offer maximum protection. Access for the plane will be by the opening provided by the vertical area defined by the cantilevered apex beam 16 and lateral support members

Figure 6:
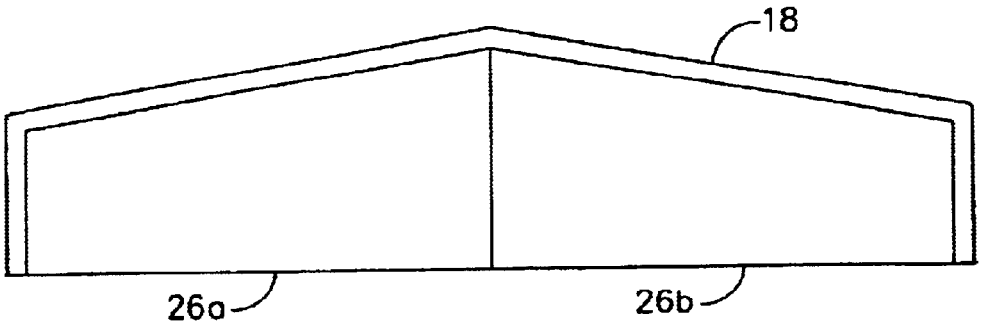
FIG. 6 is a front elevation view of the present invention including optional front door flaps. The door flaps are shown in the closed position.

14*a,b*. Though normally open, the front of the airplane shelter 10 may be covered by extensions of covering material 18 to form door flaps 26*a,b*, as can be seen in FIG. 6.

Because of the nature of the open skeletal frame and the unique cantilevered apex beam 16, airplane 30 can be easily moved in and out of the airplane shelter 10 formed by the combination of the open skeletal frame, connected cables, and covering material 18. There is no rigid non-moveable structure obstructing the movement of airplane 30, because the vertical support members define arched cross sections that are wider and higher than the tail assembly of airplane 30, and the lateral support members 14*a,b* define a distance wider that the span of wings 32*a,b* of airplane 30.

Figure 2:
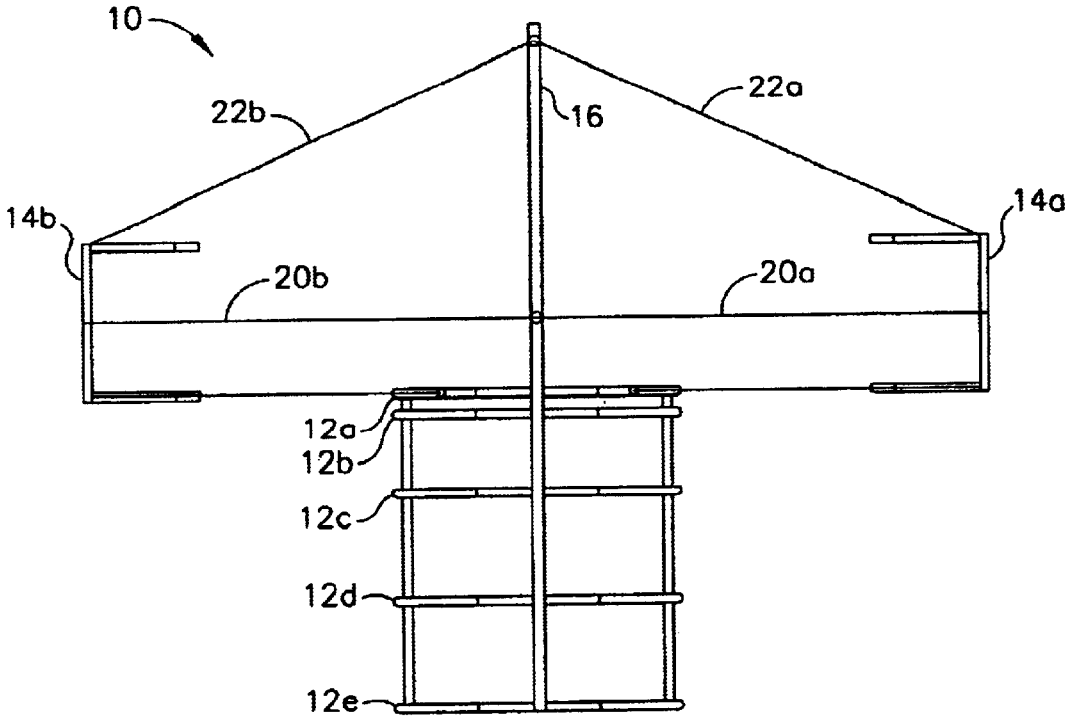
FIG. 2 is a top plan view of the open skeletal frame, without covering material, of the present invention.
Figure 3:
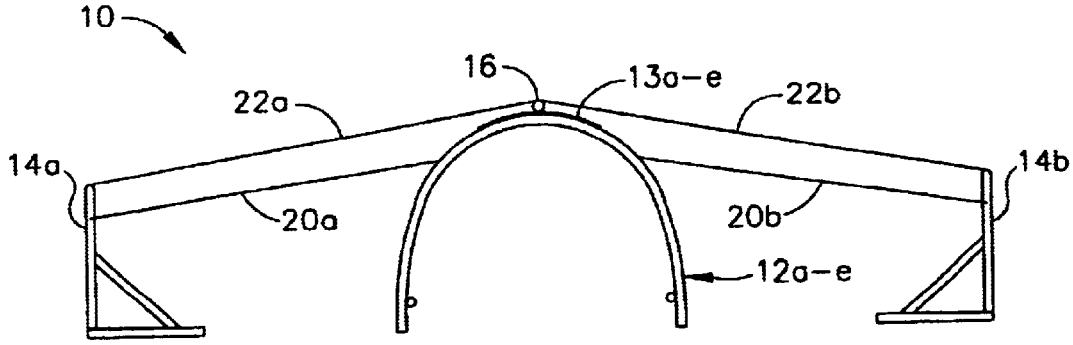
FIG. 3 is a front elevation view open skeletal frame depicted in FIG. 2.
Figure 4:
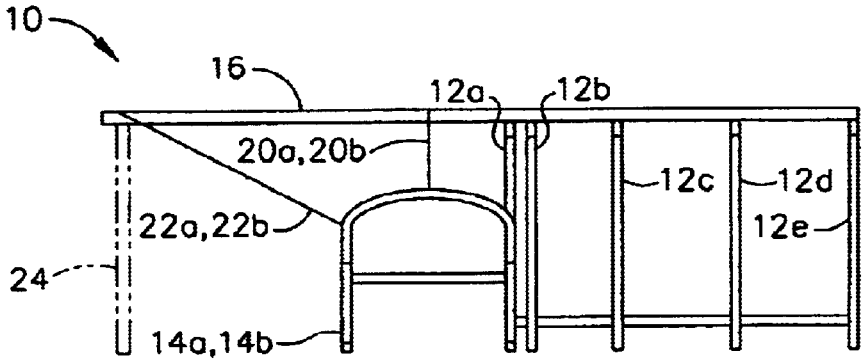
FIG. 4 is a side elevation view of the open skeletal frame depicted in FIG. 2. The removable anchor member is also shown.
Figure 5:
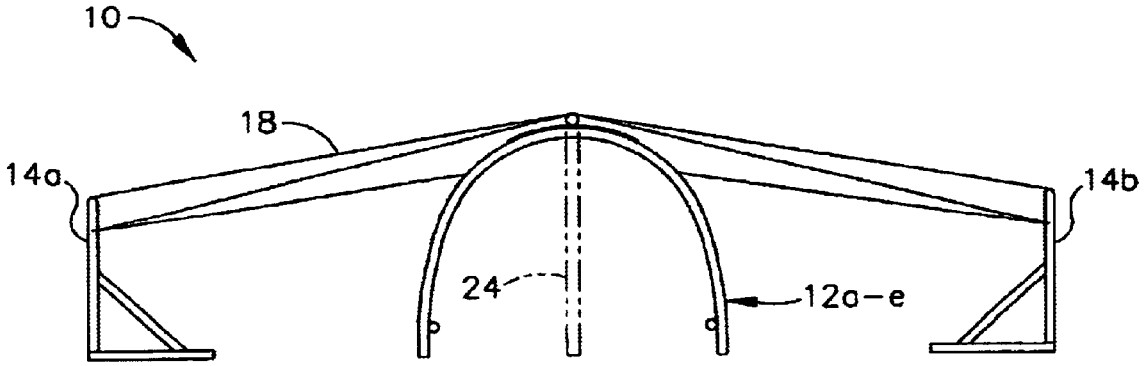
FIG. 5 is a front elevation view of the present invention showing both the covering material and removable anchor member.
Figure 7:
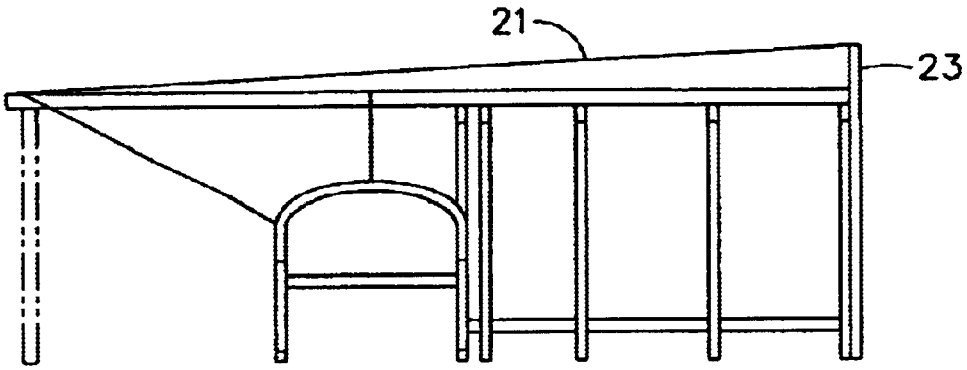
FIG. 7 depicts the present invention as shown in FIG. 4 with the additional depiction of cantilever support cable 21 and cantilever support cable anchor 23.

If additional support is desired for covering material 18 over the expanse between cantilevered apex beam 16 and lateral support members 14*a,b*, cables may be strung between points on these elements of the structure. Supplemental cantilevered beams 17*a,b* may also be attached to the plurality of vertical support members 12*a–e*. FIGS. 2, 3, and 4 depict central support cables 20*a,b* and forward support cables 22*a,b*. FIG. 8 depicts supplemental cantilevered beams 17*a,b*. Further, it may be desirable to provide additional vertical support to the forwardmost end of cantilevered apex beam 16 by fastening a cantilever support cable 21, as shown in FIG. 7, between the forwardmost end of cantilevered apex beam 16 and a cantilever support cable anchor 23. Cantilever support cable anchor 23 is in the form of a vertical pole or similar rigid member mounted at or near the rear end of airplane shelter 10 and rising vertically above the height of cantilevered apex beam 16. As depicted in FIGS. 4 and 5, a removable anchor member 24 may be used to provide restraint on the free movement of the free forward end of cantilevered apex beam 16. Removable anchor member 24 may be a rope, chain, cable or similar flexible material removably attached to the forward free end of cantilevered apex beam 18 and to a point on the ground or other suitable anchor. If desired, anchor member 24 may also be a wood, metal, or plastic pole or other relatively rigid member. If a rigid member is used, anchor member 24 also provides additional vertical support for covering material 18, adding resistance to additional loads due to collected snow and/or water in inclement weather conditions.

In an alternative embodiment of the present invention, covering material 18 may be of a stiffer material such as wood, plastic or sheet metal.

It is anticipated that the elements of the present invention could be provided as a kit for assembly by a consumer, though such is not necessary to embody the inventive concepts of the present invention.

What is claimed is:

1. A shelter for an airplane having a fuselage, wingtip and a tail, said shelter comprising:

a plurality of vertical support members arranged parallel to each other and adapted to extend over the fuselage of an airplane between the rearmost point of the tail of said airplane and the trailing edge of the wings of said airplane;

a cantilevered apex beam attached to an upper portion of each one of said plurality of vertical support members, forming an upright-standing shelter structure with said cantilevered apex beam, extending forwardly beyond the forwardmost one of said plurality of vertical support members;

a pair of lateral support members adapted to be positioned proximate to each wingtip of said airplane; covering material arranged over said shelter structure and extending forward to the forwardmost end of said cantilevered apex beam and laterally to each said pair of lateral support members such that said airplane is adapted to fit entirely beneath said covering material; and support cables attached to said cantilevered apex beam and to each of said lateral support members for supporting said covering material over the wings of said airplane.

2. The shelter for airplanes of claim 1, further including:

an elongated anchor member releasably attached to said cantilevered apex beam and to an anchor point for inhibiting undesired motion of said cantilevered apex beam.

3. A shelter for an airplane having a tail, fuselage and wings, said shelter comprising:

a plurality of vertical support members, each being configured such that the tail of an airplane may freely pass thereunder and each having a respective apex, said plurality of vertical support members arranged in a line to define a three-dimensional space sufficient to accommodate at least that portion of said airplane consisting of the fuselage and tail of said airplane from the rearmost point of said airplane from the rearmost point of the tail to the trailing edge of the wings;

anchoring means for causing each of said plurality of vertical support members to stand upright and prevent horizontal movement of each of said plurality of vertical support members;

a cantilevered apex beam, attached to said respective apex of each of said plurality of vertical support members, said cantilevered apex beam having a length equal to at least the overall length of said airplane and formed of a material such that it resists excessive bending, said cantilevered apex beam extending forwardly of the forwardmost one of said plurality of vertical support members;

first and second lateral support members adapted to be respectively positioned proximate to each wingtip of said airplane, and a covering material stretched taught and fastened over said plurality of vertical support members to form an enclosed space generally conforming to the maximum dimensions of said airplane's wings trailing edge, said covering material also fastened to each of said first and second lateral support members and to the forward most end of said cantilevered apex beam such that an awning is formed of sufficient dimension to accommodate the wings, cabin, and nose of said airplane; and support cables attached to that portion of said cantilevered apex beam that extends forwardly beyond the forward most one of said vertical support members and respectively to each of said lateral support members such that said covering material is supported over the wings of said airplane.

4. The shelter of claim 3 further including:

an elongated anchor member releasably attached to the forward most end of said cantilevered apex beam and to an anchor point for inhibiting undesired motion of said cantilevered apex beam.

5. A shelter for airplanes having a fuselage, tail and wings, said shelter comprising:

a plurality of support members forming arches having an apex;

a beam attached at the apex of each of said vertical support members, said beam extending from said vertical support members such that the beam forms a cantilever;

free-standing lateral support members adapted to be positioned at the end of the wings;

an anchor means connected to said lateral support members, for securing the shelter to the ground and;

covering material placed over said lateral support members, said beam and said vertical support members thereby forming a roof for the shelter.

6. The shelter of claim 5 wherein said anchor means includes sinking said lateral support members into a cement pad.

7. The shelter of claim 5 wherein said lateral support members include a diagonal cross-brace for providing support to said lateral support member and the shelter.

* * * * *